United States Patent [19]

Yang

[11] Patent Number: 4,493,634

[45] Date of Patent: Jan. 15, 1985

[54] KEROSENE HEATING STOVE WITH TEMPERATURE AND CARBONIC OXIDE SENSORS

[76] Inventor: Jerry S. C. Yang, 5-1 Tay Pyng St., Shi Hwu Jenn, Jang Huah Shiann, Taiwan

[21] Appl. No.: 372,829

[22] Filed: Apr. 28, 1982

[51] Int. Cl.[3] ..... F23N 5/00

[52] U.S. Cl. ..... 431/33; 431/76; 431/146; 431/304; 431/317; 126/96

[58] Field of Search ..... 431/34, 76, 301, 320, 431/344, 305, 315, 316, 317, 146, 150, 152, 33, 304; 126/96, 45, 84, 97, 93, 110 B, 110 D; 98/50

[56] References Cited

U.S. PATENT DOCUMENTS

| | | | |
|---|---|---|---|
| 2,363,443 | 11/1944 | Shagaloff | 126/96 X |
| 2,835,886 | 5/1958 | Bogdanowski | 431/76 X |
| 4,392,813 | 7/1983 | Tanaka et al. | 431/76 |

FOREIGN PATENT DOCUMENTS

| | | | |
|---|---|---|---|
| 53-7850 | 1/1978 | Japan | 431/76 |
| 55-53638 | 4/1980 | Japan | 431/34 |

*Primary Examiner*—Randall L. Green

*Attorney, Agent, or Firm*—Cushman, Darby & Cushman

[57] ABSTRACT

A kerosene heating stove is equipped with a temperature sensor and a carbonic oxide sensor. The temperature of a space is maintained at a constant level by automatically increasing and decreasing the burning length of a wick in the kerosene heating stove to change the height of the heating flame. The carbonic oxide sensor automatically generates an alarm and decreases the length of the wick to extinguish the flame if the concentration of carbonic oxide in the space increases to a predetermined dangerous level. In another embodiment, a kerosene heating stove is provided with a humidifier which automatically permits water to flow into an evaporating container in proximity to the flame when the moisture content of the air in the space falls below a predetermined level in order to regulate the moisture content of the air.

11 Claims, 14 Drawing Figures

KEROSENE HEATING STOVE WITH TEMPERATURE AND CARBONIC OXIDE SENSORS

FIELD OF THE INVENTION:

This invention relates to kerosene heating stoves, and more particularly to a kerosene heating stove including constant temperature and carbonic oxide sensors.

BACKGROUND OF THE INVENTION

The heating stove is a winter-time applicance to keep a room warm. Generally, heating stoves may be classified into two types, i.e., the electric heater and the oil heating stove. A kerosene heating stove generates heat by burning kerosene, and the heat is concentrically reflected by a reflecting board to direct the heat produced to increase the warming effect. It is a rather popular appliance because of its lower manufacturing and fuel costs compared with that of an electric heater. However, the conventional kerosene heating stove is not designed with an automatic temperature reguator, and produces a carbonic oxide during burning which will jeopardize the user's health. Therefore, it is not only inconvenient to use conventional kerosene stoves, but also their use may also cause an accident through man-made negligence.

SUMMARY OF THE INVENTION

In view of the drawbacks of the conventional kerosene heating stove, the inventor has developed a kerosene heating stove with constant temperature and carbonic oxide sensors. The said constant temperature sensor is used for setting the temperature and regulating it automatically according to a predetermined temperature range. The carbonic oxide sensor automatically generates an alarm and turns off the heating stove in case the level of carbon oxide in the room has increased to a predetermined dangerous level. The resulting stove is more practical and safer to use.

BRIEF DESCRIPTION OF THE DRAWINGS

The embodiment of this invention is described in detail by referring to the drawings as follows.

DETAILED DESCRIPTION OF THE PREFERRED EMBODIMENT

Figure 1:
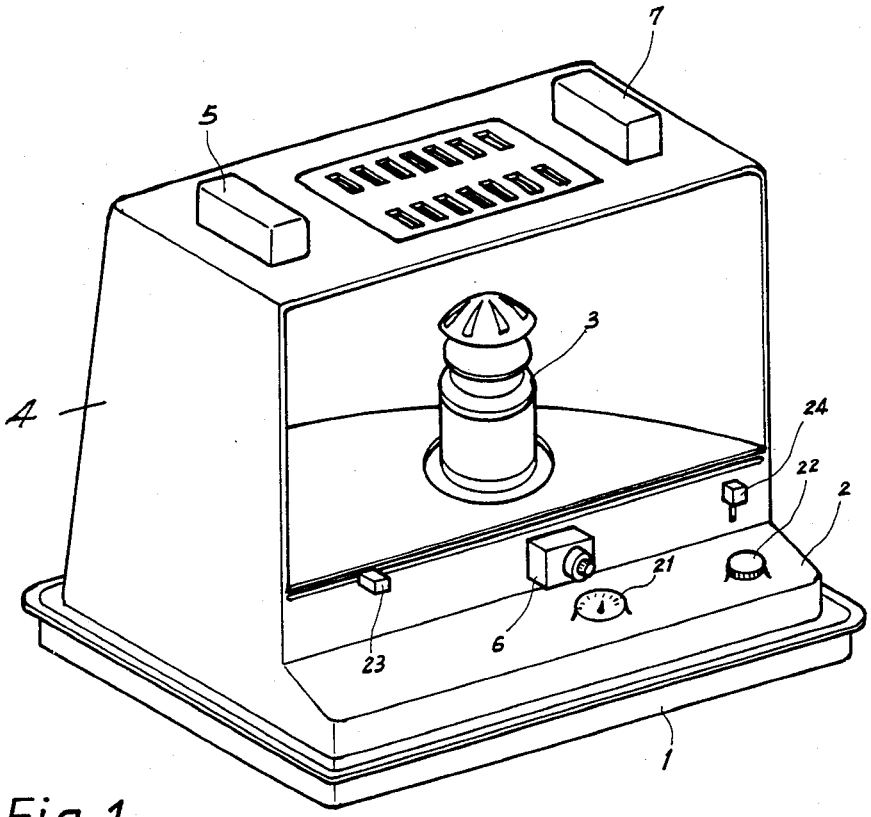
FIG. 1 is a side elevational perspective view of a first presently preferred embodiment of the present invention.
Figure 3:
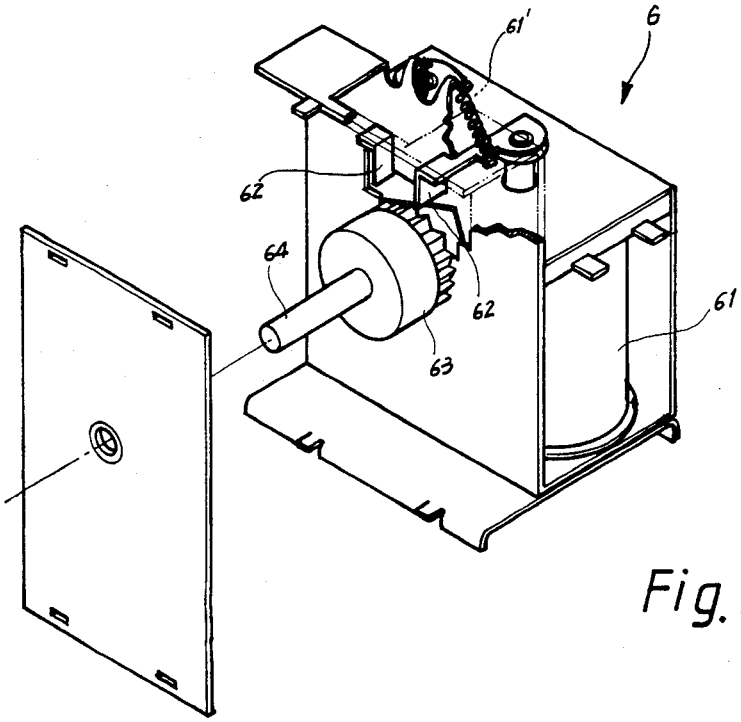
FIG. 3 is an elevational perspective view of the automatic temperature regulating switch of the embodiment shown in FIG. 1.
Figure 2A:
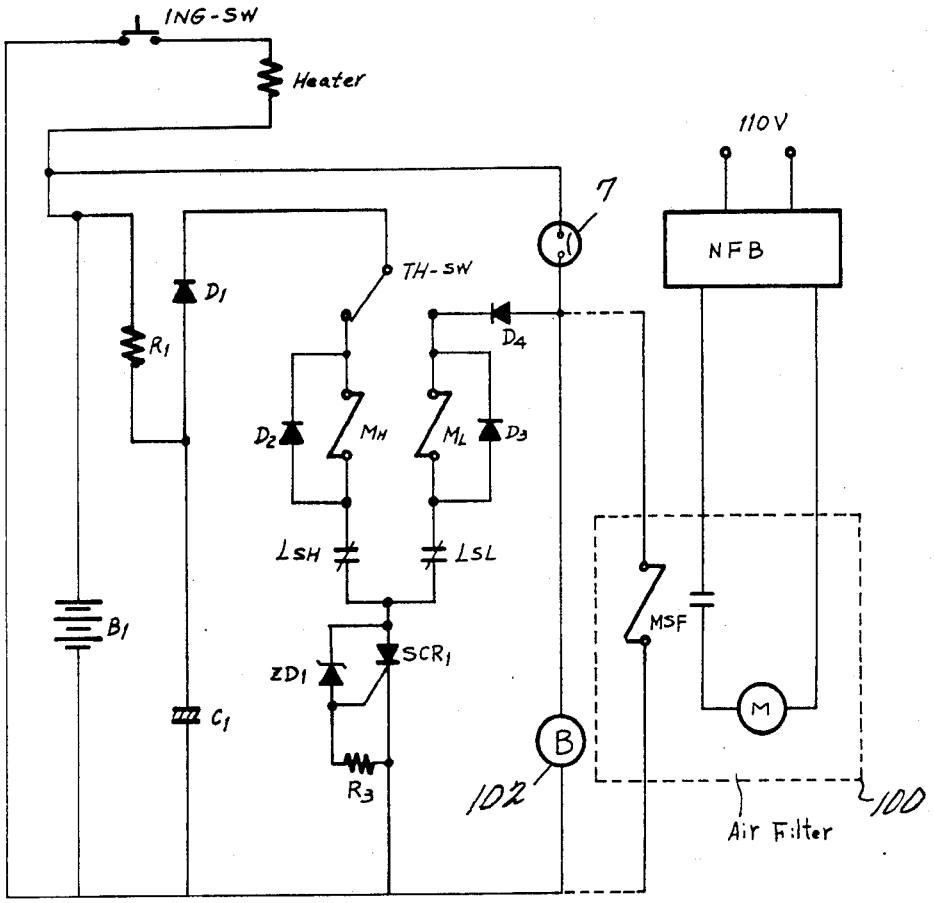
FIGS. 2(A) and 2(B) are schematic diagrams of first and second embodiments of control circuits of the embodiment of the invention shown in FIG. 1.
Figure 2:
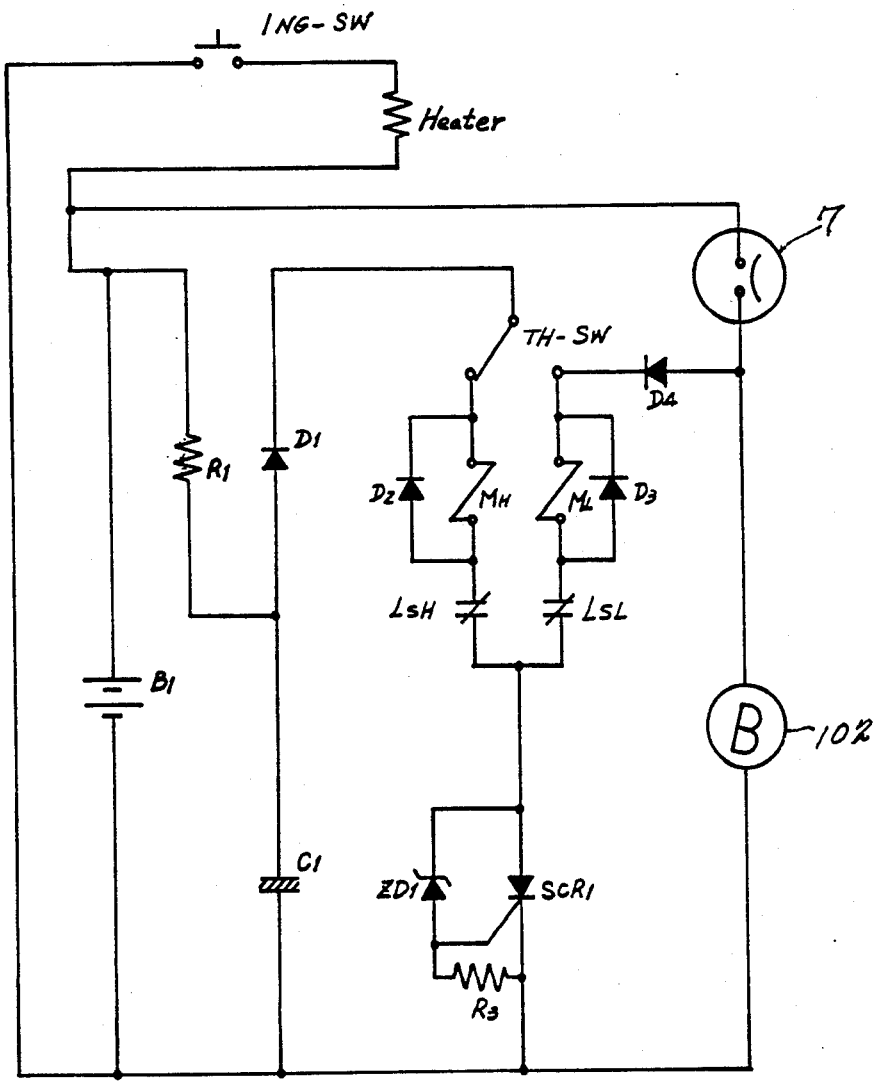

FIG. 1 shows a kerosene heating stove in accordance with the present invention, including a base (1), a body (2), a stove shade (3), and an outer cover (4). Said base (1) is used for mounting said body (2) and other related parts, and the bottom of said body (2) is a hollow container for storing kerosene. On the top of said body, a fuel level gauge (21) and an oil inlet (22) are installed. In the center of the body (2), there is a cotton wick, and an ignition means (not shown), over which stove shade (3) is mounted. Inside the body (2), there is a transversely movable lid which is used for covering said cotton wick when the stove is not in use, and which may be moved away from the cotton wick to a given position with the handle (23) when using the stove. Pressing rod (24) is pressed to cause the ignition means to kindle the cotton wick. The aforesaid cotton wick, the ignition means, the movable lid and the ignition method are all well-known, and are operated conventionally; therefore, no detailed descriptions are given.

In the general kerosene heating stove, the size of the flame is regulated by moving up or down the cotton wick manually. Therefore the stove temperature can not be regulated automatically. In this invention, a temperature sensing means (5) is provided at a suitable position in the body (2), and may be pre-set with a maximum and minimum temperature range. An automatic regulating means (6) that controls said cotton wick to move up and down is also furnished in body 12. While the stove is used, if its temperature is raised to the maximum point preset, the control circuit will drive a solenoid (61) of the temperature automatic regulating means (6). Solenoid (61) will generate a magnetic field to cause a plucking piece (62) to continuously pluck a ratchet wheel (63), rotating it in a given direction so as to move the spindle (64) to drive the cotton wick downwards to reduce the flame and the temperature as well. When the room temperature decreases to the minimum point preset, said control circuit will drive another solenoid (61') in said temperature automatic regulating means (6) to generate a magnetic field to cause another plucking piece (62') to continuously pluck said ratchet wheel (63) rotating it in a reverse direction so as to move said cotton wick upwards to increase the size of the flame, thus raising the room temperature. Therefore automatic regulation of temperature is accomplished.

Said automatic regulating means may also be operated by means of a drive motor controlled by said control circuit to drive a speed retarding means which is coupled to the spindle (64) of said temperature automatic regulating means, which will perform the same function of temperature regulation as mentioned above. Further, the temperature regulation may also be performed by manual driving means.

At a suitable position on said body (2), a carbonic oxide sensing means (7) is provided. Carbonic oxide sensing means 7 is preset usually at a level that is lower than the dangerous dosage. When the kerosene heating stove is burning (especially during sleeping at night), the oxygen in the room is greatly reduced through long periods of burning the kerosene, and a considerable amount of carbonic oxide which jeopardizes human health is yielded.

When the carbonic oxide reaches the value preset in the sensing means, a buzzer 102 or other type of alarm means will generate a sound warning signal; simultaneously, the control circuit will drive said temperature automatic regulating means (6) to lower the cotton wick, and to move said transversely movable lid for covering the cotton wick to cause the flame to be extinguished, and also to drive a ventilation system 100 or electric fan cause the room air current to circulate effectively so as to protect the user's safety.

An air humidity regulator accessory installed on a kerosene stove includes a water tank, a humidity setter, a container for evaporation under the heating process, and the air a water supply controller, which uses the humidity setter to select a proper tensile position. When the humidity in the air drops and becomes dry, a water supply regulator is driven to open the water outlet of the tank. The water flows into the container for evaporation under the heating process either by flame or by the heater. In evaporating, the moisture of the container dissipates into the air and thus increases the humidity of the air. When the humidity of the air reaches a certain content, the water supply regulator shuts off the outlet of the water tank to disrupt its supply to the evaporating container so that automatic air humidity regulation can be achieved.

Figure 4:
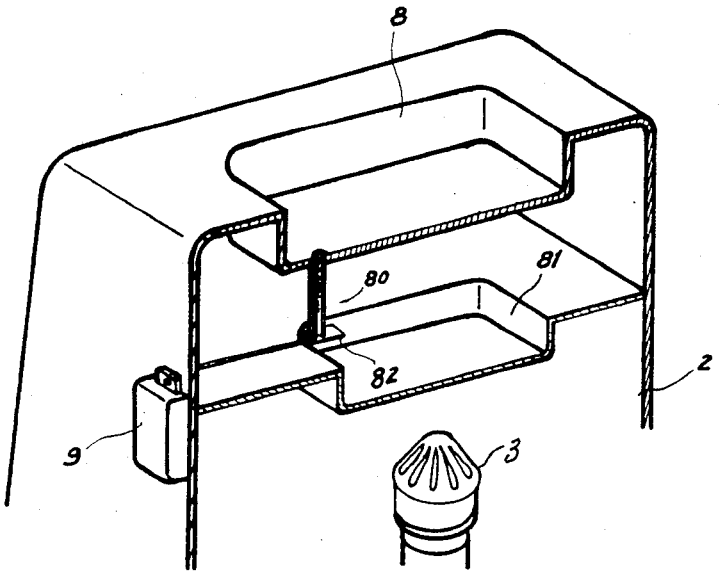
FIG. 4 is a sectional view of a second presently preferred embodiment of the present invention including a humidifier.

Generally on hot summer days, most houses use air-conditioners to regulate the room temperature, in the cold winter time, heating systems or stoves are used to increase the temperature of the room. Using air-conditioners or stoves over a long period of time will cause the air in the room to become drier than usual, thus impairing the health of the respiratory organs. In order to improve the above defect, one feature of this invention is a humidity preset regulator to be installed on a kerosene. When the air moisture is reduced to become drier than normal, the humidity preset regulator automatically activates the water supply regulator to open the outlet of the water tank. Water flowing into the container evaporates into moisture which dissipates into the air. Thus, humidity in the air increases due to the evaporation. When the humidity reaches a certain content, the humidity setter is able to block the outgoing passage of water into the water tank, interrupting the water supply and thus achieving automatic regulation of the humidity in the air. This accessory can be installed in the kerosene stove or air-conditioner and (cool or warm conditioner) can be independent in its operation. FIG. 4 shows a kerosene stove provided with a humidifier which includes a water tank (8), a humidity setter (9), a container for evaporation (81), a water supply regulator (82), etc. The functions of the structure and the theory of motions are described as follows:

A Water (8) is installed on the upper part of the stove's main body (2). Water tank (8) may be incorporated into the main body (2) or separately installed. The bottom of the tank (8) has a water outlet (80) in the shape of pipe, into which sponges or other water that can absorb the water are stuffed. The opening and closing of water outlet (80) of the tank is controlled by the water supply regulator (82). The water is supplied to evaporation container (81) through the water outlet or exit (80).

Figure 5:
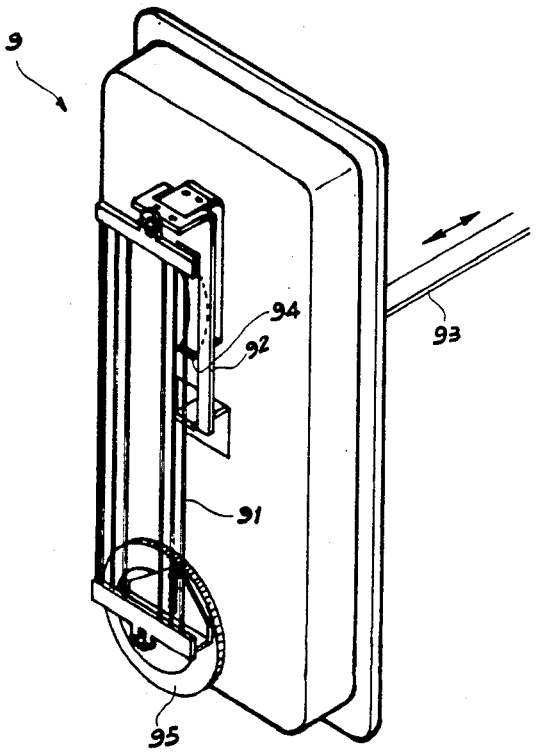
FIG. 5 is a side elevational perspective view of the humidity setter of the embodiment shown in FIG. 4.

A Humidity setter (9) employs the customary practice of changing tensile force by alteration of temperatures to drive a mechanism or electric appliance in order that an expected result or function can be achieved. Referring to FIGS. 4 and 5, a humidity setter can be installed at a location between the water tank (8) and evaporation container (81) under the heating element (3). When the moisture in the air becomes excessively scarce or the air is too dry, a horse tail (91) becomes tense, producing pulling force to drive the mechanism, thereby causing the water supply regulator to open its exit (80) so that water flows into the container (81) from the tank (8). The container receives the heat for evaporation from the flames of the kerosene and dissipates the moisture into air to increase the humidity of the air. When the humidity in the air reaches a certain content, the horse tail (91) swells as result of its dampness, activating a mechanism to recoil to the original position by tensile force, the water supply regulator thus blocks the exit (80) of the water. The reciprocal movements of this kind regulate the humidity in the air. This invention utilizes the horse tail's tenseness when it dries and its relaxation when it is damp to achieve the expected results.

Referring to FIG. 5, when the horse tail (91) is dry and becomes tense, the movable piece (92) is pulled and it, in turn, draws the pulling lever (93) which connects with the end of the movable piece and causes the water supply regulator (82) to open the exit (80). The exit shuts off in a converse fashion. The movable piece (92) is installed with a curve-shaped spring (94) to increase the traveling space of its movement. Settings and adjustments can be made by a switch button (95). The switch button (95) commbines with the convex ratchet wheel into one body, as is shown on the drawing. When the switch button (95) turns on, the convex ratchet wheel reaches a proper position, and the horse tail (91) is set to be in a certain tension state. When the horse tail (91) is high or below the preset valve of the humidity in air, it will pull or relax in action, as is expected.

Evaporation container (81) is installed on the water tank which is located at the upper part of main body (2) of the heating stove. The flame of the stove is under the container so that when the water flows into the container, it boils to evaporate and its moisture dissipates into the air, thus increasing the humidity of air. Water Supply Regulator (82) is a mechanical structure of the dam type which receives the pushing force of the humidity setter to open or close the exit (80) of the water tank (8), thus controlling the water supply. If the humidity setter is equipped with an electrical power output, then the regulator will be an electro-magnetic valve.

Humidity setter (9) can adapt itself to preset timed opening according to our need, i.e., it is adjustable and subject to determination and selection by time.

Figure 6:
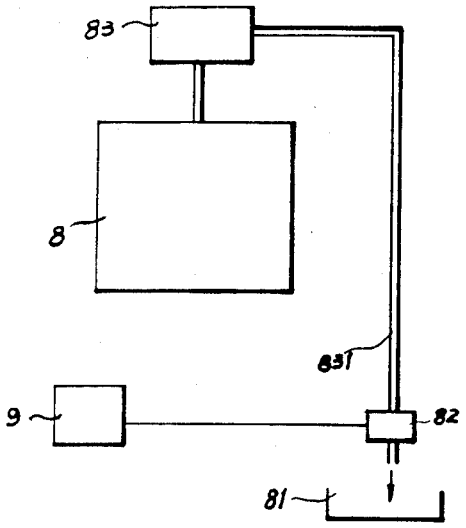
FIG. 6 schematically shows a second presently preferred embodiment of a humidifier in accordance with the present invention.
Figure 7:
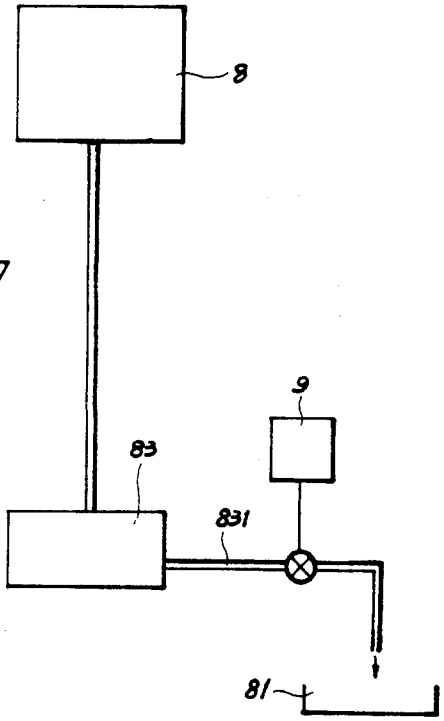
FIG. 7 schematically shows a third presently preferred embodiment of a humidifier in accordance with the present invention.

FIGS. 6 and 7 show installations of the humidity setter alternative to the arrangement shown in FIG. 4. Referring to FIG. 6, water is drawn and siphoned from the water tank (8) according to the capillary theory and then flows into the evaporation container (81). Referring to FIG. 7, there is shown on auxilliary reservoir container (83) installed at a proper altitude to be equipped with a water pipe (831). Between the water pipe (831) and the container (81), there is a water supply regulator (82). The auxilliary reservoir container (83) stores a fixed amount of water and the water in the water tank (8) supplies water at a fixed amount into the evaporator container (81). When the water supply regulator opens, water from the auxilliary reservoir container (83) flows into the evaporator container (81) through the water pipe (831). As soon as the water level of the auxilliary reservoir (83) drops to a minimum, its water supply automatically stops.

Figure 8:
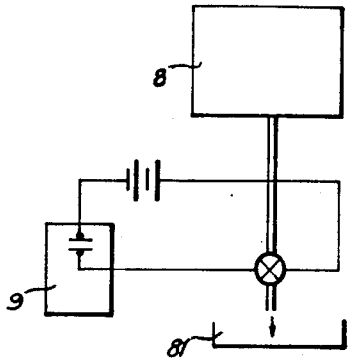
FIG. 8 schematically shows a fourth presently preferred embodiment of a humidifier in accordance with the present invention.
Figure 9:
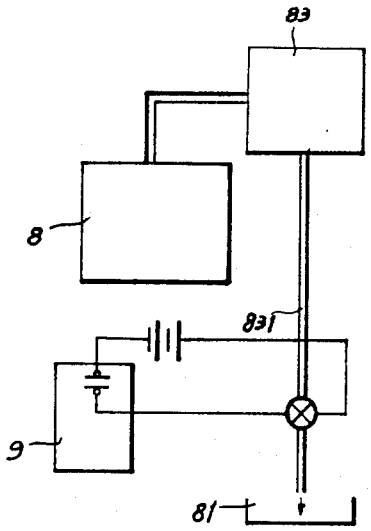
FIG. 9 schematically shows a fifth presently preferred embodiment of a humidifier in accordance with the present invention.
Figure 10:
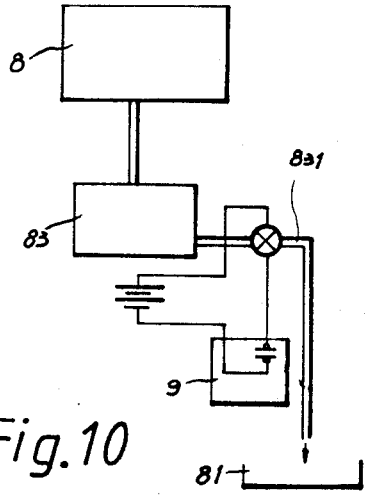
FIG. 10 schematically shows a sixth presently preferred embodiment of a humidifier in accordance with the present invention.
Figure 11:
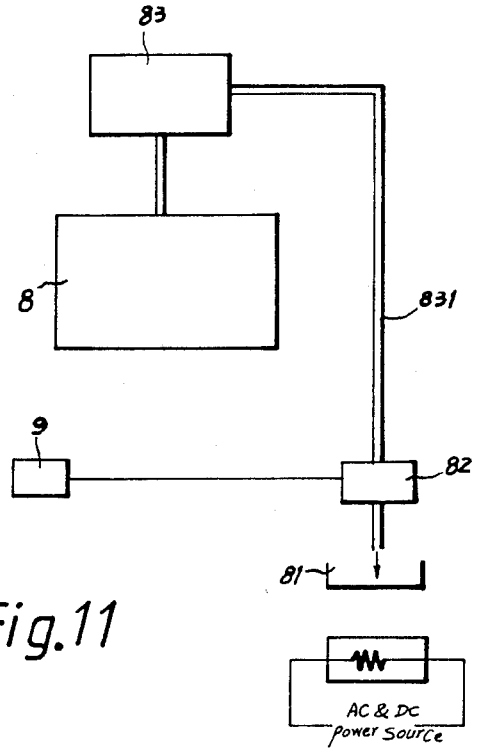
FIG. 11 schematically shows a seventh presently preferred embodiment of a humidifier in accordance with the present invention.
Figure 12:
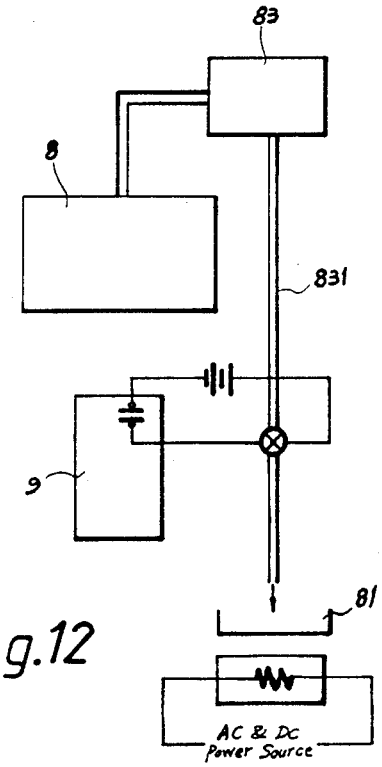
FIG. 12 schematically shows an eighth presently preferred embodiment of a humidifier in accordance with the present invention.
Figure 13:
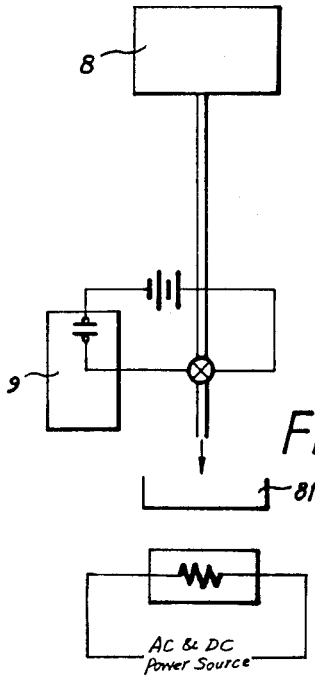
FIG. 13 schematically shows a ninth presently preferred embodiment of a humidifier in accordance with the present invention.

Those embodiments in FIGS. 4–7 are electro-magnetically operated examples of the water supply regulator. Those embodiments shown in FIG. 8–10 are of the electro-magnetic type. Their functions are all the same. The humidity setter which is applied to the kerosene stove in accordance with this invention can also be used in other applications to replace the energy-consuming and noisy dehumidifier. The embodiments shown in 11–13 are examples of evaporation by using the heater to convert the water into moisture.

I claim:

1. An apparatus for heating a space, said apparatus comprising:

reservoir means for storing a quantity of combustible liquid;

wick means for producing a flame by burning said combustible liquid, a first portion of the length of said wick means being adapted for immersion into said combustible liquid, a second portion of the length of said wick means being adapted for burning said combustible liquid to produce said flame;

temperature sensing means for producing a signal indicative of the temperature of the air in said space; and temperature regulating means, responsive to said temperature-indicative signal, for adjusting the height of said wick means in order to change the height of said flame so as to maintain constant temperature of said air in said space, said temperature regulating means, also reducing the height of said wick means to decrease the height of said flame in response to a warning signal;

carbonic oxide sensing means for producing said warning signal when the level of carbonic oxide produced by said flame accumulated in said space exceeds a predetermined level dangerous to a user; and movable lid means, responsive to said warning signal, for covering said wick means to extinguish said flame when said warning signal is produced.

2. An apparatus as in claim 1 further comprising ventilating means, responsive to said warning signal, for ventilating said space when said level of carbonic oxide exceeds said predetermined level.

3. An apparatus as in claim 1 further comprising audible alarm means responsive to said warning signal for producing an audible alarm when said level of carbonic oxide exceeds said predetermined level.

4. An apparatus for heating a space, said apparatus comprising:

reservoir means for storing a quantity of combustible liquid;

wick means for producing a flame by burning said combustible liquid, a first portion of the length of said wick means being adapted for immersion into said combustible liquid, a second portion of the length of said wick means being adapted for burning said combustible liquid to produce said flame;

temperature sensing means for producing a signal indicative of the temperature of the air in said space; and temperature regulating means, responsive to said temperature-indicative signal, for adjusting the height of said wick means in order to change the height of said flame so as to maintain said air in said space at a constant temperature, said temperature regulating means also reducing the height of said wick means to decrease the height of said flame in response to a warning signal;

carbonic oxide sensing means for producing said warning signal when the level of carbonic oxide produced by said flame accumulated in said space exceeds a predetermined level dangerous to a user; and ventilating means, responsive to said warning signal, for ventilating said space when said level of carbonic oxide exceeds said predetermined level.

5. A kerosene heating stove for heating a space, comprising:

reservoir means for storing a quantity of kerosene;

wick means for producing a flame by burning said kerosene, a first portion of the length of said wick means being adapted for immersion into said kerosene, a second portion of the length of said wick means being adapted for burning said kerosene to produce said flame;

carbonic oxide sensing means for producing a warning signal when the level of carbonic oxide produced by said flame accumulated in said space reaches a predetermined level dangerous to a user;

temperature sensing means for producing at least one signal indicative of the temperature of the air in said space;

temperature regulating means, responsive to said temperature-indicative signal and/or said warning signal, for selectively raising and lowering said wick means in order to change the height of said flame so as to maintain constant temperature of said air in said space and to reduce the size of said flame when said warning signal is produced; and movable lid means, responsive to said warning signal, for covering said wick means to extinguish said flame when said warning signal is produced.

6. A kerosene heating stove as in claim 5 wherein:

said temperature sensing means produces a first signal when the temperature of said air in said space is above a first predetermined temperature and a second signal when the temperature of said air in said space is below a second predetermined temperature lower than said first predetermined level; and said temperature regulating means lowers said wick means to decrease the height of said flame when said first signal is produced and raises said wick means to increase the height of said flame when said second signal is produced.

7. A kerosene heating stove as in claim 6 wherein said temperature means includes;

first solenoid means responsive to said first signal for producing a first magnetic field;

second solenoid means responsive to said second signal and to said warning signal for producing a second magnetic field;

a rotatable ratchet wheel;

first pawl means for being attracted by said first magnetic field into contact with said rotatable ratchet wheel to rotate said ratchet wheel in a first direction;

second pawl means for being attracted by said second magnetic field into contact with said rotatable ratchet wheel to rotate said ratchet wheel in a second direction opposite to said first direction; and spindlle means coupled to said ratchet wheel for lowering said wick means when said ratchet wheel is rotated in said first direction and for raising said wick mean when said ratchet wheel is rotated in said second direction.

8. A kerosene heating stove as in claim 7 wherein:

said predetermined level of carbonic oxide dangerous to a user is the minimum dangerous dosage level of carbonic oxide for a human being; and said stove further includes audible alarm means, responsive to said warning signal, for producing an audible alarm signal when said level of carbonic oxide exceeds said predetermined level.

9. A kerosene heating stove as in claim 6 wherein said temperature regulating means includes:

motor means for producing rotational energy;

speed reducing means, coupled to said motor means, for decreasing the angular velocity of the rotational energy produced by said motor means;

spindle means, coupled to said speed reducing means, for lowering said wick means when said motor means rotates in a first direction and for raising said wick means when said motor means rotates in a second direction opposite to said first direction; and motor control means, responsive to said first signal, said second signal and said warning signal, for actuating said motor means to rotate in said first direction when said first signal is produced, and to rotate in said second direction when one or both of said second signal and said warning signal is produced.

10. A kerosene heating stove as in claim 5 wherein:

said predetermined level of carbonic oxide dangerous to a user is the minimum dangerous dosage level of carbonic oxide for a human being; and said stove further includes audible alarm means, responsive to said warning signal, for producing an audible alarm signal when said level of carbonic oxide exceeds said predetermined level.

11. A kerosene heating stove as in claim 5 further comprising ventilating means responsive to said warning signal for ventilating the air in said space when said level of carbonic oxide exceeds said predetermined level.

* * * * *